US006389249B2

(12) United States Patent
Kabumoto et al.

(10) Patent No.: US 6,389,249 B2
(45) Date of Patent: May 14, 2002

(54) IMAGE FORMING APPARATUS WITH A PLURALITY OF UNITS OPERATIVELY CONNECTED TOGETHER

(75) Inventors: Masaaki Kabumoto, Chiba; Kazuyoshi Yamada, Kanagawa, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/817,026

(22) Filed: Mar. 27, 2001

Related U.S. Application Data

(63) Continuation of application No. 09/488,675, filed on Jan. 21, 2000, now Pat. No. 6,266,475.

(30) Foreign Application Priority Data

Jan. 22, 1999 (JP) ..... 11-13756
Dec. 16, 1999 (JP) ..... 11-357945

(51) Int. Cl.[7] ..... G03G 15/00
(52) U.S. Cl. ..... 399/107; 399/110
(58) Field of Search ..... 399/88, 107, 110, 399/113, 126

(56) References Cited

U.S. PATENT DOCUMENTS 5,105,210 A * 4/1992 Hirano et al. ..... 346/145
6,215,970 B1 * 4/2001 Yoshikawa et al. ..... 399/124

FOREIGN PATENT DOCUMENTS

JP 6-242677 * 9/1994
JP 2000133956 * 5/2000

* cited by examiner

*Primary Examiner*—Quana M. Grainger
(74) *Attorney, Agent, or Firm*—Oblon, Spivak, McClelland, Maier & Neustadt, P.C.

(57) ABSTRACT

An image forming apparatus with a plurality of units operatively connected together is disclosed. A main power switch is mounted on one side wall of a copier body unit while a paper discharge unit next to the copier body unit is formed with a recess facing the main power switch. The recess defines an opening only great enough for a person to touch the main power switch with a fingertip. Even when the different units are combined without any clearance therebetween, the main power switch can be operated via the above opening. In addition, the main power switch is not easily visible and can therefore be prevented from being inadvertently turned off.

22 Claims, 4 Drawing Sheets

IMAGE FORMING APPARATUS WITH A PLURALITY OF UNITS OPERATIVELY CONNECTED TOGETHER

This application is a continuation of application Ser. No. 09/488,675 filed on Jan. 21, 2000, now U.S. Pat. No. 6,266,475.

BACKGROUND OF THE INVENTION

The present invention relates to an image forming apparatus with a plurality of units operatively connected together and more particularly to an image forming apparatus improved in configuration and structure in consideration of the layout of a plurality of units.

Conventional copiers, printers or similar image forming apparatuses include one having an image forming unit and a mass paper feed unit, a paper discharge unit and a paper finishing unit operatively connected to the image forming unit. Another conventional image forming apparatus is made up of a plurality of large size units, e.g., an image processing unit and other units sequentially arranged at one side of an image forming unit. In this case, a personal computer is mounted on the top of the image processing unit.

However, the problem with the conventional image forming apparatuses of the kind described is that they pay little attention to the easy-to-operate configuration of the entire arrangement although paying much attention to advanced functions available with the combination of the units. For example, despite that different units are positioned side by side with hardly any clearance therebetween, a power switch, an operation button, an operation lever or similar member to be operated by hand must sometimes be provided on the side wall of one unit just adjoining the other unit.

Further, the above image forming apparatuses each include a number of units and therefore a number of motors and other drive devices. This kind of apparatus therefore produces more noise than a single small size unit and needs implementations for absorbing or insulating noise. While sound absorbing or insulating materials are customary even with the conventional apparatuses, they are not satisfactory due-to limited spaces available in the apparatuses.

Technologies relating to the present invention are disclosed in, e.g., Japanese Patent Laid-Open Publication Nos. 11-220559 and 11-254788.

SUMMARY OF THE INVENTION

It is therefore an object of the present invention to provide an image forming apparatus easy to operate even when a power switch or similar member to be operated by hand is provided on the side wall of one unit adjoining the next unit.

It is another object of the present invention to provide an image forming apparatus enhancing easy storage and sound insulation or sound absorption despite the connection of a plurality of units.

In accordance with the present invention, in an image forming apparatus having a plurality of units operatively connected together, a first unit has a power switch, an operation button, an operation lever or similar member to be operated by hand arranged on one side wall thereof while a second unit next to the first unit has a recess formed in a side wall thereof adjoining the one side wall of the first unit to thereby render the above. member accessible from the outside of the image forming apparatus.

The second unit next to the first unit may have its recess covered with an openable cover.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
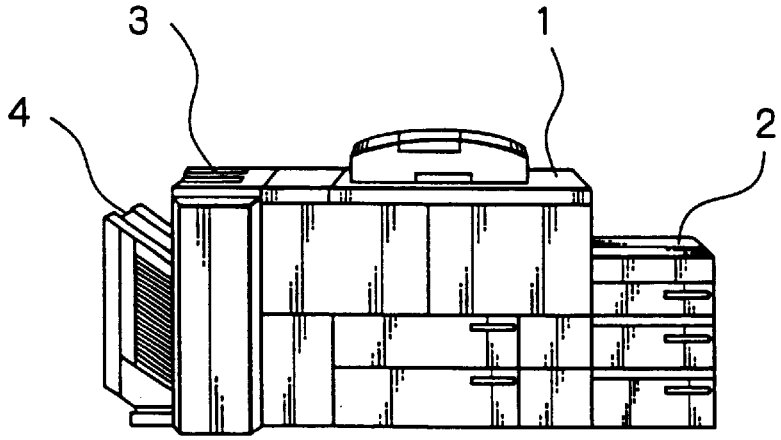
Fig. 1 PRIOR ART
FIG. 1 is an isometric view showing a conventional image forming apparatus.

To better understand the present invention, brief reference will be made to a conventional image forming apparatus, shown in FIG. 1. As shown, the image forming apparatus includes an image forming unit 1 playing the role of a major unit. Arranged around the image forming unit 1 are a mass paper feed unit 2, a paper discharge unit 3, and a paper finishing unit 4.

Figure 2:
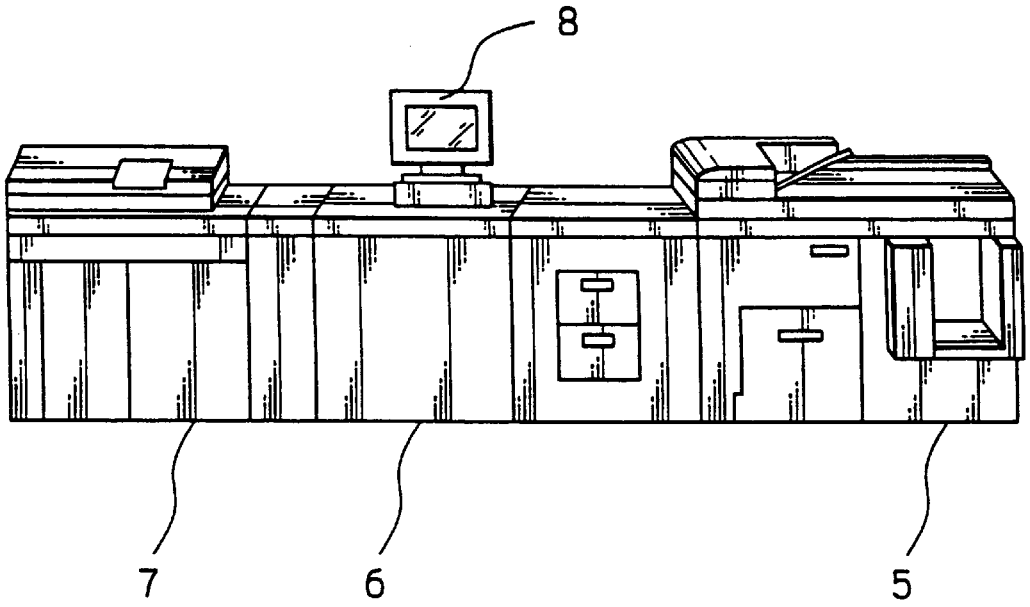
Fig. 2 PRIOR ART
FIG. 2 is an isometric view showing another conventional image forming apparatus.

FIG. 2 shows another conventional image forming apparatus of the type made up of a plurality of large size units. As shown, an image processing unit 6 and another unit 7 are sequentially arranged at one side of an image forming unit 5. A personal computer 8 is mounted on the top of the image processing unit 6. While this type of large size image forming apparatus is customary with a copy center or similar large scale facility, its application to ordinary offices is spreading.

The above conventional image forming apparatuses have the previously discussed problems left unsolved.

Figure 3:
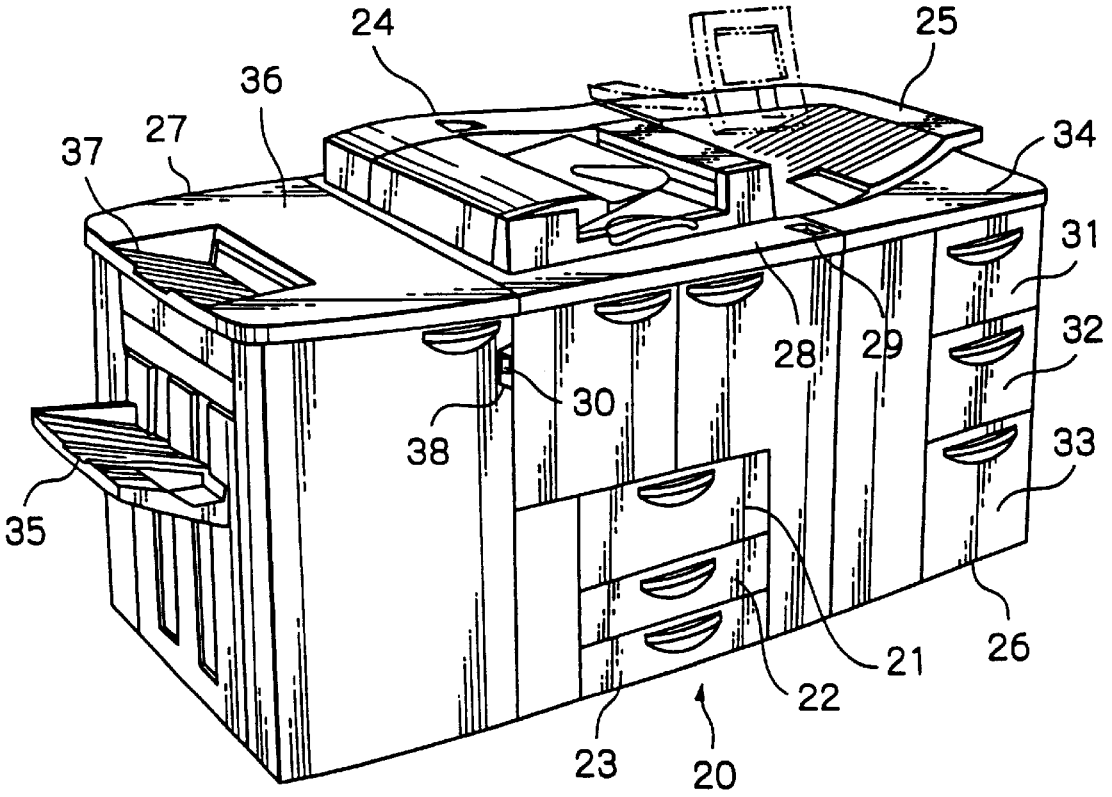
FIG. 3 is an isometric view showing the front end of an image forming apparatus embodying the present invention.
Figure 4:
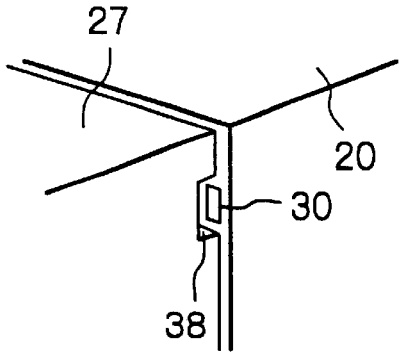
FIG. 4 is a fragmentary isometric.view of the illustrative embodiment.

Referring to FIGS. 3 and 4, an image forming apparatus embodying the present invention and implemented as a copier by way of example will be described. As shown, the copier includes a copier body unit 20 including removable paper trays 21 through 23, an ADF (Automatic Document Feeder) 24, and a document discharge tray 25. A mass paper feed unit 26 and a paper discharge unit 27 are positioned at both sides of the copier body unit 20. The copier body unit 20, mass paper feed unit 26 and paper discharge unit 27 all have generally flat front ends and have substantially the same height and depth, as illustrated.

The ADF 24 is positioned at substantially the center of a table-like top 28 included in the copier body unit 20. The document d discharge tray 25 is positioned at the right-hand side of the ADF 24, as viewed in FIG. 3. The top 28 of the copier body unit 20 other than the portions occupied by the ADF 24 and tray 25 is flat. A power switch 29 is positioned in a small recess or pocket formed in the top 28. A main power switch 30 is positioned on the left side wall of the copier body unit 20, as viewed in FIG. 3. Assume that the copier body unit 20 is implemented as a multiplex machine including a printer function, a facsimile function and other additional functions and must be constantly powered all day long. Then, the main power switch 20 must not be turned off and is successfully prevented from being inadvertently turned off when located at the above particular position of the copier body unit 20.

The mass paper feed unit 26 includes a plurality of paper feed stages 31 through 33 and has a top 34. The top 34, like the top 28 of the copier body unit 20, is flat except for its portion removed to accommodate the document discharge tray 25. The removed portion of the top 28 assigned to the tray 25 has only a negligibly small area.

The paper discharge unit 27 has a mass paper discharge tray 35 mounted on its left side wall, as viewed in FIG. 3; the tray 35 is movable up and down. The paper discharge unit 27 has a top 36 whose left edge portion, as viewed in FIG. 3, is removed at its intermediate portion in order to accommodate a paper discharge tray 37. The top 36 is also flat except for the area where the paper discharge tray 37 is located.

When the copier body unit 20, mass paper feed unit 26 and paper discharge unit 27 having the above configurations are connected together to constitute a single image forming apparatus, the tops 28, 34 and 36 contiguous with each other form an extremely broad flat top. In this condition, even if a work table, for example, is not available around the apparatus, the fiat top offers an area broad enough to put, e.g., documents, copies, clips or pens.

The paper discharge unit 27 has one corner portion where a front wall and a right side wall thereof, as viewed in FIG. 3, join each other partly removed in the form of an opening 38, as illustrated. The opening 38 faces the main power switch 30 mounted on the left side wall of the copier body unit 20. The opening 38 is so sized as to allow a person to only turn on and turn off the main power switch 30 with a fingertip. That is, the opening 38 maintains the main power switch 30 accessible even when the copier body unit 20 and paper discharge unit 27 are arranged side by side without any clearance therebetween, as shown in FIG. 4. In addition, a person intending to leave the office is prevented from inadvertently turning off the main power switch 30 because the switch 30 is not easily visible. This is also true when the main power switch 30 is positioned between the copier body unit 20 and the mass paper feed unit 26.

Figure 5:
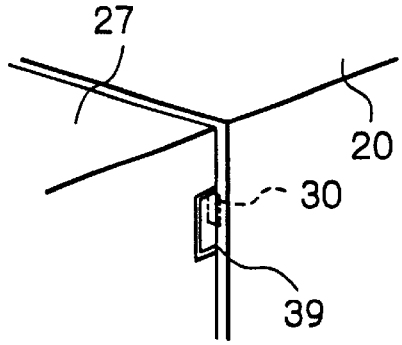
FIG. 5 is a fragmentary isometric view schematically showing a modification of the illustrative embodiment.

FIG. 5 shows a modification of the illustrative embodiment. As shown, the modification is identical with the illustrative embodiment except that the opening 38 is closed by an openable cover 39. The cover 39 allows the main power switch 30 to escape observation more positively.

Figure 6:
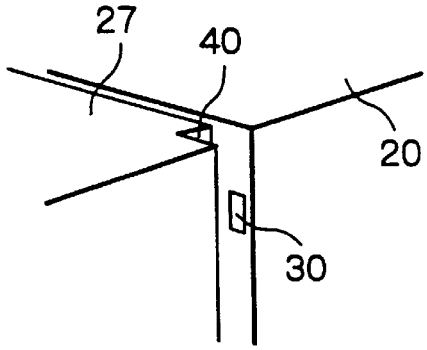
FIG. 6 is a fragmentary isometric view schematically showing an alternative embodiment of the present invention.

FIG. 6 shows an alternative embodiment of the present invention. As shown, the main power switch 30 is again mounted on the left side wall of the copier body unit 20. In this embodiment, to make the main power switch 30 accessible, the corner portion of the paper discharge unit 27 where the front wall and right side wall join each other is removed over the entire height of the unit 27, forming a recess 40. As for the rest of the configuration and the operation of the switch 30, this embodiment is identical with the previous embodiment.

Figure 7:
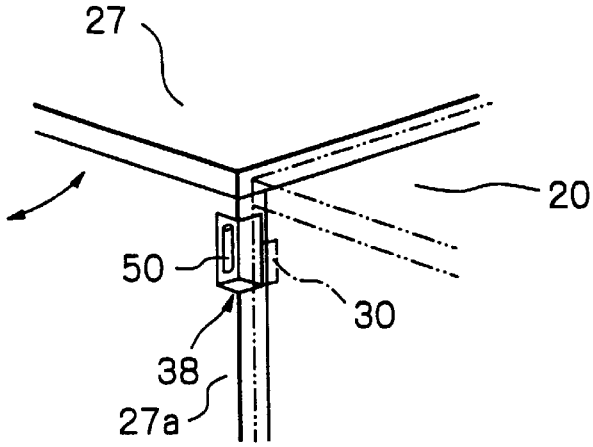
FIG. 7 is a fragmentary isometric view schematically showing another alternative embodiment of the present invention.

Reference will be made to FIG. 7 for describing another alternative embodiment of the present invention. FIG. 7 is different from FIGS. 4 through 6 in that it is so drawn as to make the inside of the opening 38 visible, as seen from the copier body unit 20 side. As shown, a hollow or grip 50 is formed in the wall of the opening 38 identical with the opening 38 of FIG. 4, so that a person can open the front wall 27*a* of the paper discharge unit 27 by holding the edge of the hollow 50. With this configuration, this embodiment not only allows a person to operate the main power switch 30, as needed, but also makes at least a knob provided on the front wall of the paper discharge unit 27, as shown in FIG. 3, needless. This further enhances the flatness of the front end of the paper discharge unit 27 and is also true with the other units.

If desired, the hollow or grip 50 may be replaced with a projection protruding into the opening 38. Further, such a simple hollow or projection may be replaced with any suitable conventional structure or configuration easy to operate, e.g., means mounted on the frame, not shown, of the paper discharge unit 27 for latching and unlatching the front wall 27*a*. Of course, this embodiment may be combined with the modification shown in FIG. 5 or the embodiment shown in FIG. 6.

While the illustrative embodiments and modification thereof have concentrated on a switch and a grip, the present invention is, of course, applicable to all kinds of buttons, levers and so forth to be operated by hand.

Figure 8:
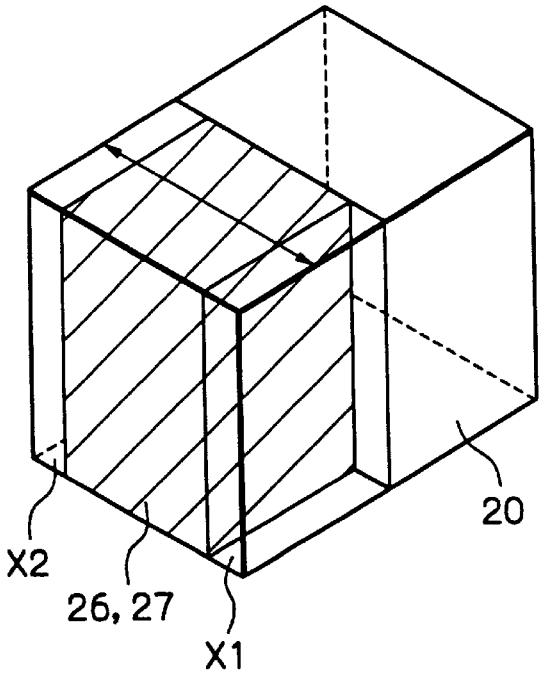
FIGS. 8 and 9 are perspective views each for describing a particular reason of a depth adopted by the illustrative embodiments and modification thereof.

In the illustrative embodiments and modification thereof, the mass paper feed unit 26 and paper discharge unit 27 are provided with a depth identical with the depth of the copier body unit 20 despite that they, in practice, need only a depth great enough to pass a paper therethrough. This will be described more specifically with reference to FIG. 8. As shown, the mass paper feed unit 27 and paper discharge unit 27 each are originally operable if provided with only a depth indicated by hatching. In the illustrative embodiments and modification thereof, the depth indicated by hatching is extended to the depth of the copier body unit 20, as indicated by a double-headed arrow. As a result, margins X1 and X2 are available for accommodating, e.g., papers or arranging sound absorbing or insulating members. Of course, the above extension of the depth broadens the space available on the tops of the mass paper feed unit 26 and paper discharge unit 27, as stated earlier. This configuration, coupled with the switch arrangement shown in any one of FIGS. 3 through 6, allows a switch to be positioned even on the side wall of the copier body unit 20 which is hidden by the other unit 26 or 27.

Figure 9:
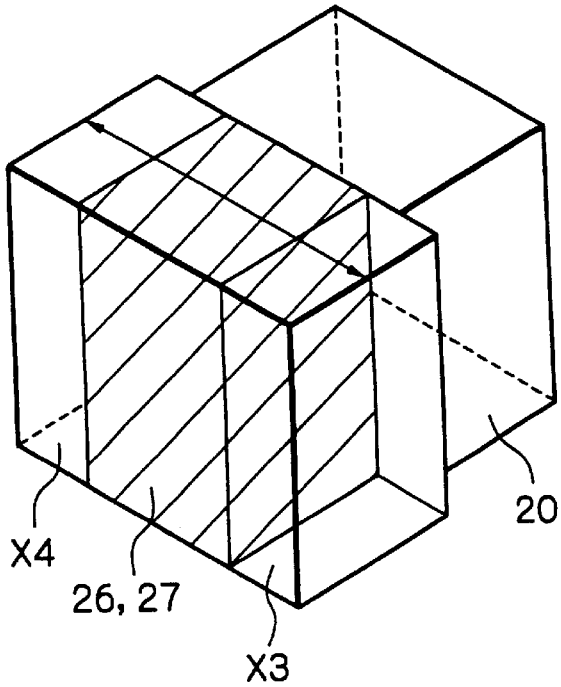

As shown in FIG. 9, the depth of the mass paper feed unit 26 or that of the paper discharge unit 27 may be further extended to provide the unit with greater margins X3 and X4 for the above-stated purposes.

In summary, it will be seen that the present invention provides an image forming apparatus allowing, e.g., a power switch to be operated even when positioned on the side wall of one unit which another unit adjoins. In the case of a multiple machine having various functions, the apparatus of the present invention minimizes an occurrence that a person inadvertently turns off, e.g., a switch that must be continuously turned on all day long.

Further, the apparatus of the present invention makes it needless to provide grips on the front ends of the units and thereby enhances the flatness of the front ends. In addition, the apparatus of the present invention achieves uniform and therefore attractive appearance when made up of a plurality of units.

Various modifications will become possible for those skilled in the art after receiving the teachings of the present disclosure without departing from the scope thereof.

What is claimed is:

1. An image forming apparatus having a plurality of units operatively connected together, comprising:

a first unit as a multiplex machine having a plurality of functions and provided with hand operable means arranged on one side wall and adjacent to a front wall of said first unit; and a second unit arranged adjacent to said first unit, said second unit having a recess formed in a side wall of said second unit adjoining said one side wall of said first unit to render said hand operable means accessible from an outside of said image forming apparatus and cover said hand operable means.

2. An image forming apparatus as claimed in claim 1, wherein said recess is at least partially enclosed by a portion of a recess wall facing toward said first unit.

3. An image forming apparatus as claimed in claim 2, wherein said portion of said recess wall is located at a distance from an edge of said side wall of said second unit, and said distance is at least as large as a maximal height of said hard operable means.

4. An image forming apparatus as claimed in claim 1, wherein said recess adjoins a portion of said second unit facing said hand operable means.

5. An image forming apparatus as claimed in claim 4, wherein each one of said plurality of units connected together has a substantially flat front wall.

6. An image forming apparatus as claimed in claim 4, wherein a portion of said second unit including said recess is an operable member of said second unit, either one of a hollow and a projection being formed in said recess for constituting a grip.

7. An image forming apparatus as claimed in claim 6, wherein each one of said plurality of units connected together has a substantially flat front wall.

8. An image forming apparatus as claimed in claim 1, wherein said recess comprises a notch that extends over an entire height of said second unit and that includes a portion of said second unit facing said hand operable means.

9. An image forming apparatus as claimed in claim 8, wherein each one of said plurality of units connected together has a substantially flat front wall.

10. An image forming apparatus as claimed in claim 8, wherein a portion of said second unit including said recess is an openable member of said second unit, either one of a hollow and a projection being formed in said recess for constituting a grip.

11. An image forming apparatus as claimed in claim 10, wherein each one of said plurality of units connected together has a substantially flat front wall.

12. An image forming apparatus as claimed in claim 1, wherein each one of said plurality of units connected together has a substantially flat front wall.

13. An image forming apparatus as claimed in claim 1, wherein said hand operable means comprises at least one of a power switch, an operation button, and an operation lever.

14. An image forming apparatus as claimed in claim 1, wherein said first unit and said second unit have substantially a same height.

15. An image forming apparatus as claimed in claim 1, wherein said first unit and said second unit have substantially a same width.

16. An image forming apparatus having a plurality of units operatively connected together, comprising:

a first unit as a multiplex machine having a plurality of functions and provided with hand operable means arranged on one side wall and adjacent to a front wall of said first unit;

a second unit arranged adjacent to said first unit, said second unit having a recess with an openable cover formed in a side wall of said second unit adjoining said one side wall of said first unit to render said hand operable means accessible from an outside of said image forming apparatus.

17. An image forming apparatus as claimed in claim 16, wherein each one of said plurality of units connected together has a substantially flat front wall.

18. An image forming apparatus as claimed in claim 16, wherein a portion of said second unit including said recess is an openable member of said second unit, either one of a hollow and a projection being formed in said recess for constituting a grip.

19. An image forming apparatus as claimed in claim 18, wherein each one of said plurality of units connected together has a substantially flat front wall.

20. An image forming apparatus as claimed in claim 16, wherein said hand operable means comprises at least one of a power switch, an operation button, and an operation lever.

21. An image forming apparatus as claimed in claim 16, wherein said first unit and said second unit have substantially a same height.

22. An image forming apparatus as claimed in claim 16, wherein said first unit and said second unit have substantially a same-width.

* * * * *

UNITED STATES PATENT AND TRADEMARK OFFICE

CERTIFICATE OF CORRECTION

PATENT NO. : 6,389,249 B2
DATED : May 14, 2002
INVENTOR(S) : Kabumoto et al.

It is certified that error appears in the above-identified patent and that said Letters Patent is hereby corrected as shown below:

Title page,
Item [63], the Related U.S. Application information should read:

-- Related U.S. Application Data

[63] Continuation of application No. 09/488,675, filed on Jan. 21, 2000, now Pat. No. 6,226,475. --

Signed and Sealed this

Fifth Day of November, 2002

*Attest:*

*Attesting Officer*

JAMES E. ROGAN
*Director of the United States Patent and Trademark Office*